US007080429B2

(12) United States Patent
Savicki, Sr.

(10) Patent No.: US 7,080,429 B2
(45) Date of Patent: Jul. 25, 2006

(54) CLOSURE DEVICE

(75) Inventor: Alan F. Savicki, Sr., Oswego, IL (US)

(73) Assignee: The Glad Products Company, Oakland, CA (US)

( * ) Notice: Subject to any disclaimer, the term of this patent is extended or adjusted under 35 U.S.C. 154(b) by 231 days.

(21) Appl. No.: 10/466,955

(22) PCT Filed: Mar. 13, 2001

(86) PCT No.: PCT/US01/08076

§ 371 (c)(1),
(2), (4) Date: Jul. 21, 2003

(87) PCT Pub. No.: WO02/071883

PCT Pub. Date: Sep. 19, 2002

(65) Prior Publication Data

US 2004/0045139 A1 Mar. 11, 2004

(51) Int. Cl.
*A44B 19/16* (2006.01)

(52) U.S. Cl. ..... 24/399; 24/400; 383/64

(58) Field of Classification Search ..... 24/30.5, 24/399, 400, 415, 427, 428; 383/63–65
See application file for complete search history.

(56) References Cited

U.S. PATENT DOCUMENTS

| | | | | |
|---|---|---|---|---|
| 3,230,593 A | | 1/1966 | Herz | 24/399 |
| 3,806,998 A | | 4/1974 | Laguerre | 24/400 |
| 5,007,143 A | | 4/1991 | Herrington | 24/400 |
| 5,067,208 A | * | 11/1991 | Herrington et al. | 24/400 |
| 5,070,583 A | * | 12/1991 | Herrington | 24/400 |
| 5,448,808 A | | 9/1995 | Gross | 24/400 |
| 5,664,299 A | | 9/1997 | Porchia et al. | 24/399 |
| 5,722,128 A | * | 3/1998 | Toney et al. | 24/400 |
| 6,014,795 A | | 1/2000 | McMahon et al. | 24/400 |
| 6,047,450 A | | 4/2000 | Machacek et al. | 24/399 |
| 6,220,754 B1 | | 4/2001 | Stiglic et al. | 383/64 |
| 6,402,375 B1 | * | 6/2002 | Schreiter et al. | 383/64 |
| 6,575,628 B1 | * | 6/2003 | Borchardt et al. | 383/64 |
| 6,611,998 B1 | * | 9/2003 | Stiglic | 24/427 |

* cited by examiner

*Primary Examiner*—Robert J. Sandy
*Assistant Examiner*—Ruth C. Rodriguez
(74) *Attorney, Agent, or Firm*—Thomas C. Feix

(57) ABSTRACT

A container (120) includes a closure device (121). The closure device includes interlocking fastening strips (130, 131) and a slider (132) slidably disposed on the fastening strips for facilitating the occlusion and deocclusion of the fastening strips. The slider includes first and second side portions (140, 142) and a top portion (144). The first side portion (140) includes pivot arms (158, 168). The pivot arms (158, 168) include shoulders (156, 166). The second side portion (142) includes pivot arms (152, 162). The pivot arms (152, 162) include shoulders (150, 160). The pivot arms (152, 158, 162, 168) create a pivot point for the shoulders (150, 156, 160, 166) that prevents the slider (132) from being removed from the fastening strips in the vertical Z axis (106). The shoulders move into the fastening strips when an upward force (180) is applied in the Z axis (106). The shoulders (150, 156, 160, 166) also pivot outward when the slider (132) is being attached to the fastening strips (130, 131), making it easier to attach the slider.

14 Claims, 12 Drawing Sheets

132
190
180
133
148
142
167
188
166
131
184
182
130
162
146
161
186
160

132
168
133
148
167
166
131
130
162
146
161
160
102
106

132
133
148
142
167
166
131
130
162
146
161
160

CLOSURE DEVICE

FIELD OF THE INVENTION

The present invention relates generally to closure devices and, more particularly, to a slider having shoulders whose pivot points are situated above the shoulder. The invention is particularly well suited for fastening flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements, which are used to selectively seal the bag. A slider may be provided for use in opening and closing the fastening strips. Some of these sliders include a separator. When the slider is moved in the appropriate direction, the separator divides the fastening strips and opens the bag.

The slider may include shoulders disposed along the bottom of the slider that engage the fastening strips and prevent the slider from being removed from the fastening strips. However, if enough force is applied to the slider in the vertical direction, the sides of the slider may flex outwards allowing the slider to be removed from the fastening strips. The removal of the slider after the slider has been installed is not desirable. Thus, the invention reduces the possibility of the slider being removed.

SUMMARY OF THE INVENTION

According to the teachings of the present invention, the closure device includes interlocking fastening strips. The closure device also includes a slider slidably disposed on the interlocking fastening strips for facilitating the occlusion and deocclusion of the fastening strips when moved towards first and second ends of the fastening strips. The slider includes shoulders that are attached to arms that extend outward before extending downward. This creates a pivot point for the shoulder that causes the shoulder to flex inward when an attempt is made to remove the slider, making it difficult to remove the slider. Additionally, the slider may also be easier to attach to the fastening strips.

These and other objects, features, and advantages of the present invention will become more readily apparent upon reading the following detailed description of exemplified embodiments and upon reference to the accompanying drawings herein.

While the present invention will be described and disclosed in connection with certain embodiments and procedures, the intent is not to limit the present invention to these embodiments and procedures.

DESCRIPTION OF THE EMBODIMENTS

Figure 1:
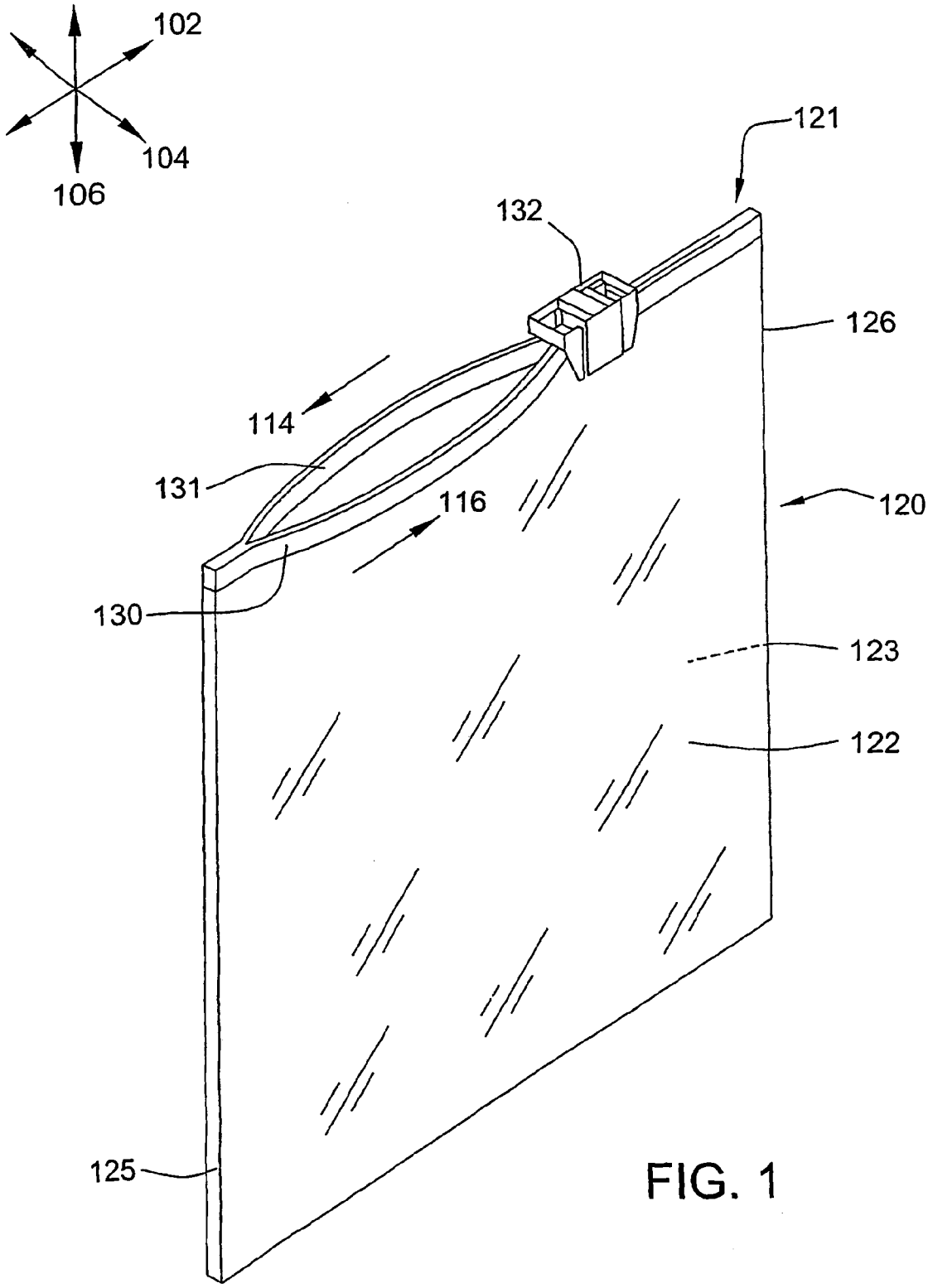
FIG. 1 is a perspective view of a container according to the present invention in the form of a plastic bag.

FIG. 1 illustrates an embodiment of a container in the form of a plastic bag 120 having a sealable closure device 121. The bag 120 includes a first sidewall 122 and a second sidewall 123 joined at seams 125, 126 to define a compartment accessible through the open top end but sealable by means of the closure device 121. The closure device 121 includes first and second fastening strips 130, 131 and a slider 132.

The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The fastening strips 130, 131 are adapted to be interlocked between a first end and a second end. The slider 132 is mounted onto the fastening strips 130, 131 so that the slider 132 is restrained from being removed from the fastening strips 130, 131 but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

Figure 2:
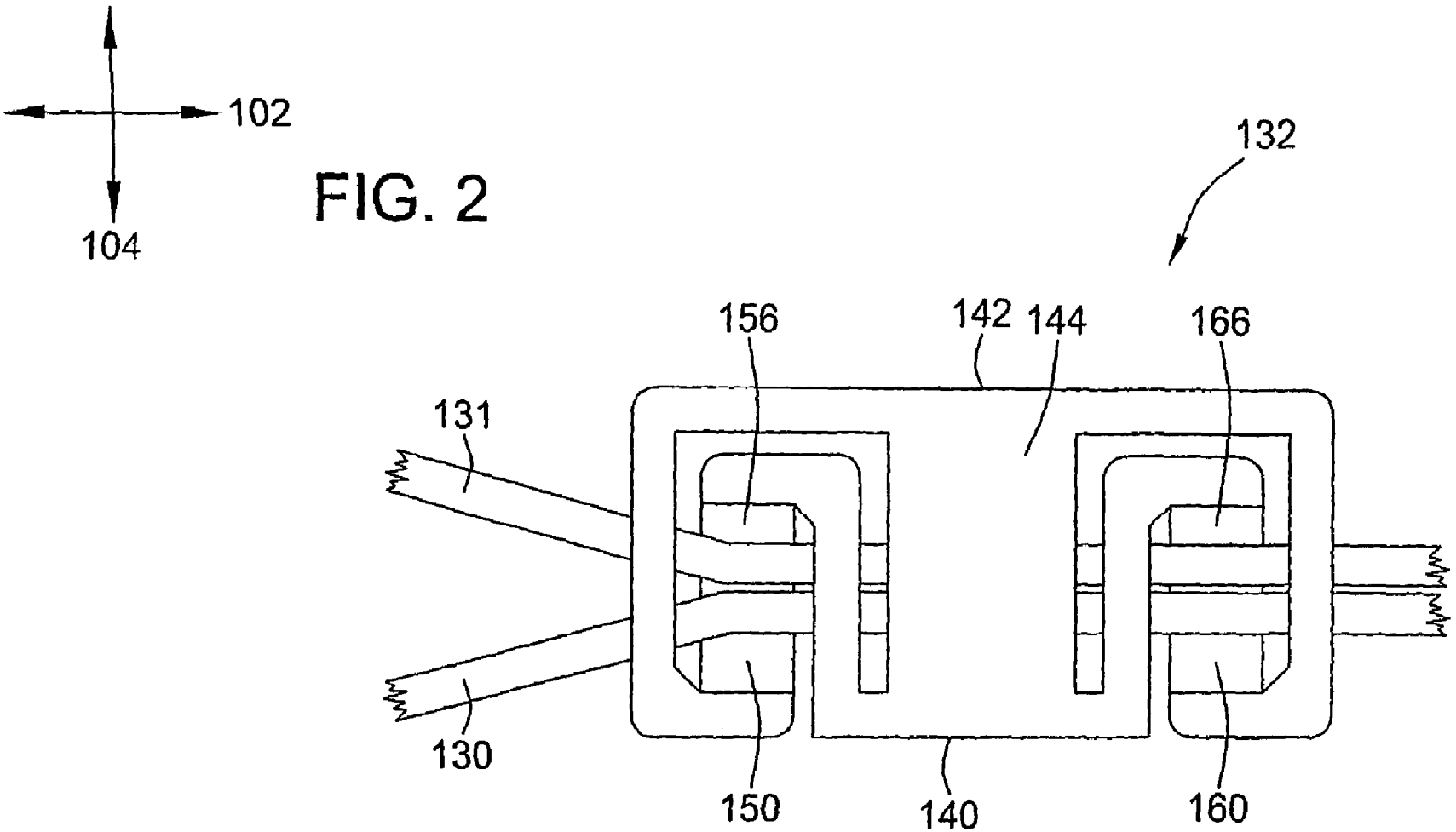
FIG. 2 is a fragmentary top view of the container in FIG. 1.

FIG. 2 illustrates a partial top view of the closure device in FIG. 1 and depicts the fastening strips 130, 131 and slider 132. The slider includes first and second side portions 140, 142 and a top portion 144. The first side portion 140 includes front and rear shoulders 156, 166. Similarly, the second side portion 142 includes front and rear shoulders 150, 160. The shoulders engage the fastening strips 130, 131 and prevent the slider from being disengaged from the fastening strips in the direction of the Z axis 106.

FIGS. 3–7 illustrate different views of the slider 132 in regards to the present invention. The slider includes first and second side portions 140, 142 that merge into a top portion 144. The slider may be manufactured as one piece or may be manufactured as multiple pieces to be assembled later. It will also be appreciated by those skilled in the art that the slider 132 may be molded from any suitable plastic material.

The top portion 144 includes a separator 133. The separator 133 facilitates the deocclusion of the fastening strips 130, 131 by providing a wedge that applies pressure to the fastening strips and forces them to disengage. The side portions 140, 142 include occlusion members 146, 148, respectively, that facilitate the occlusion of the fastening strips by applying pressure to the outside of the fastening strips.

Figure 3:
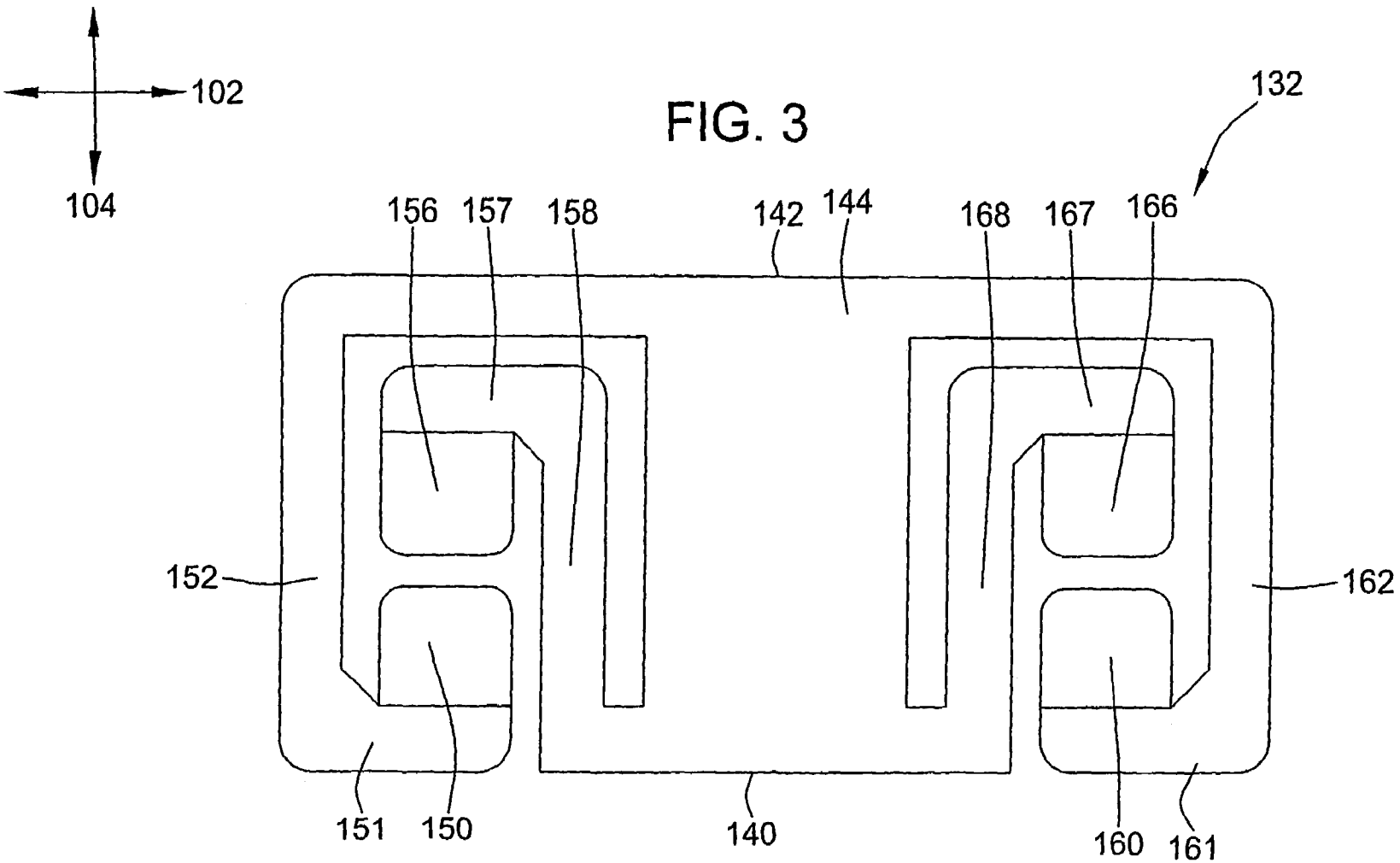
FIG. 3 is a top view of an embodiment of a slider.
Figure 4:
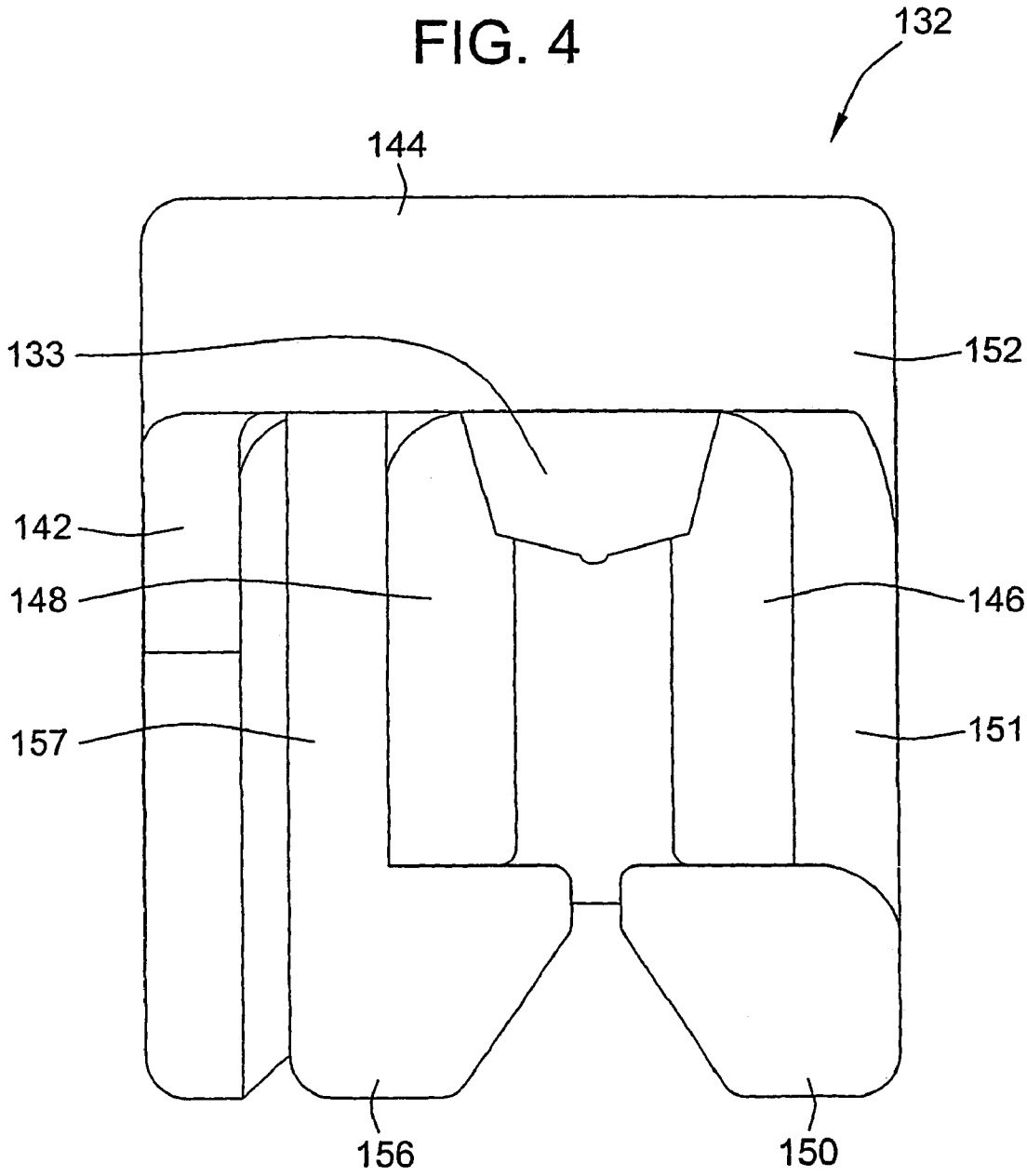
FIG. 4 is a front view of the slider in FIG. 3.
Figure 5:
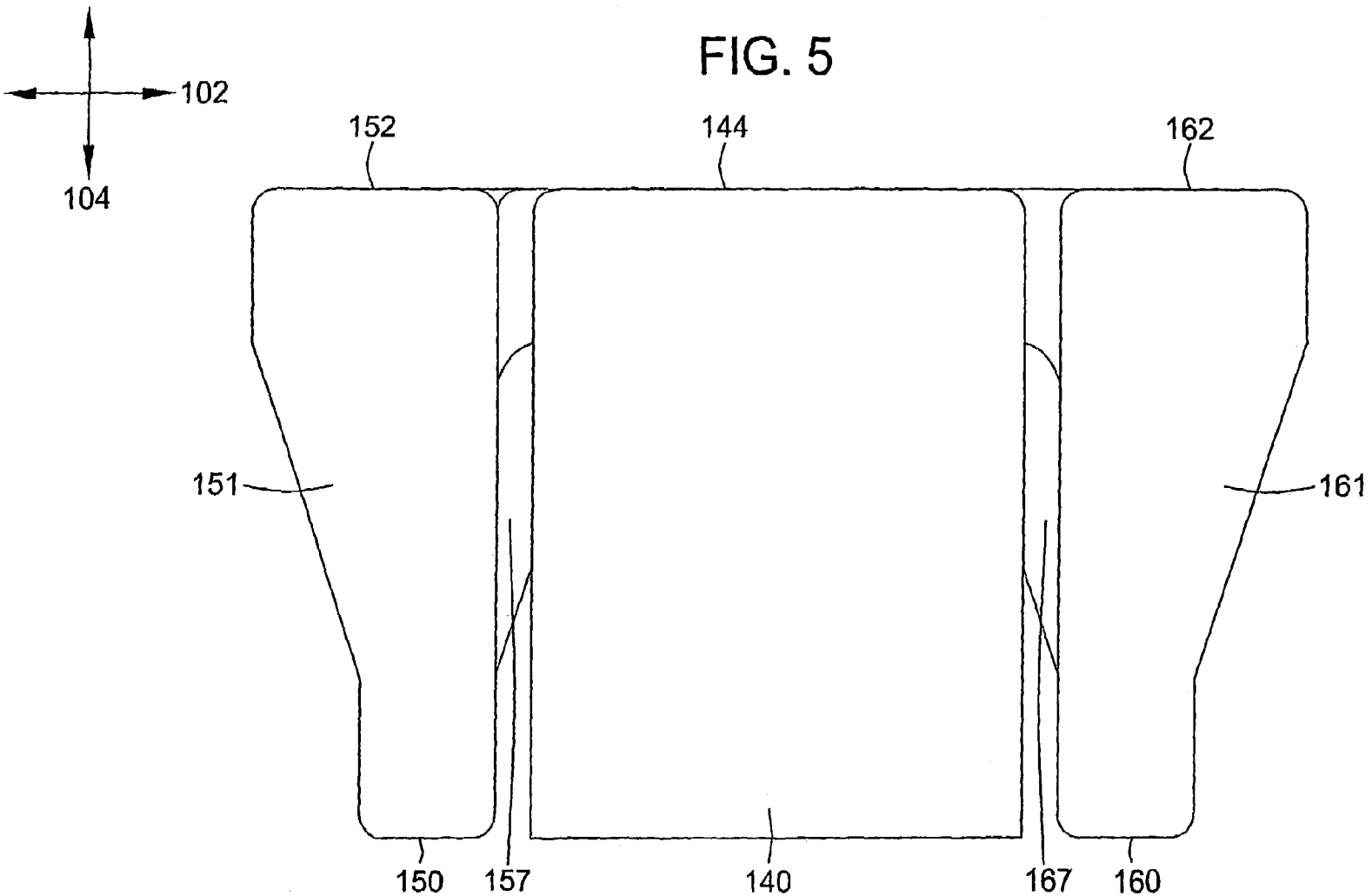
FIG. 5 is a right side view of the slider in FIG. 3.
Figure 6:
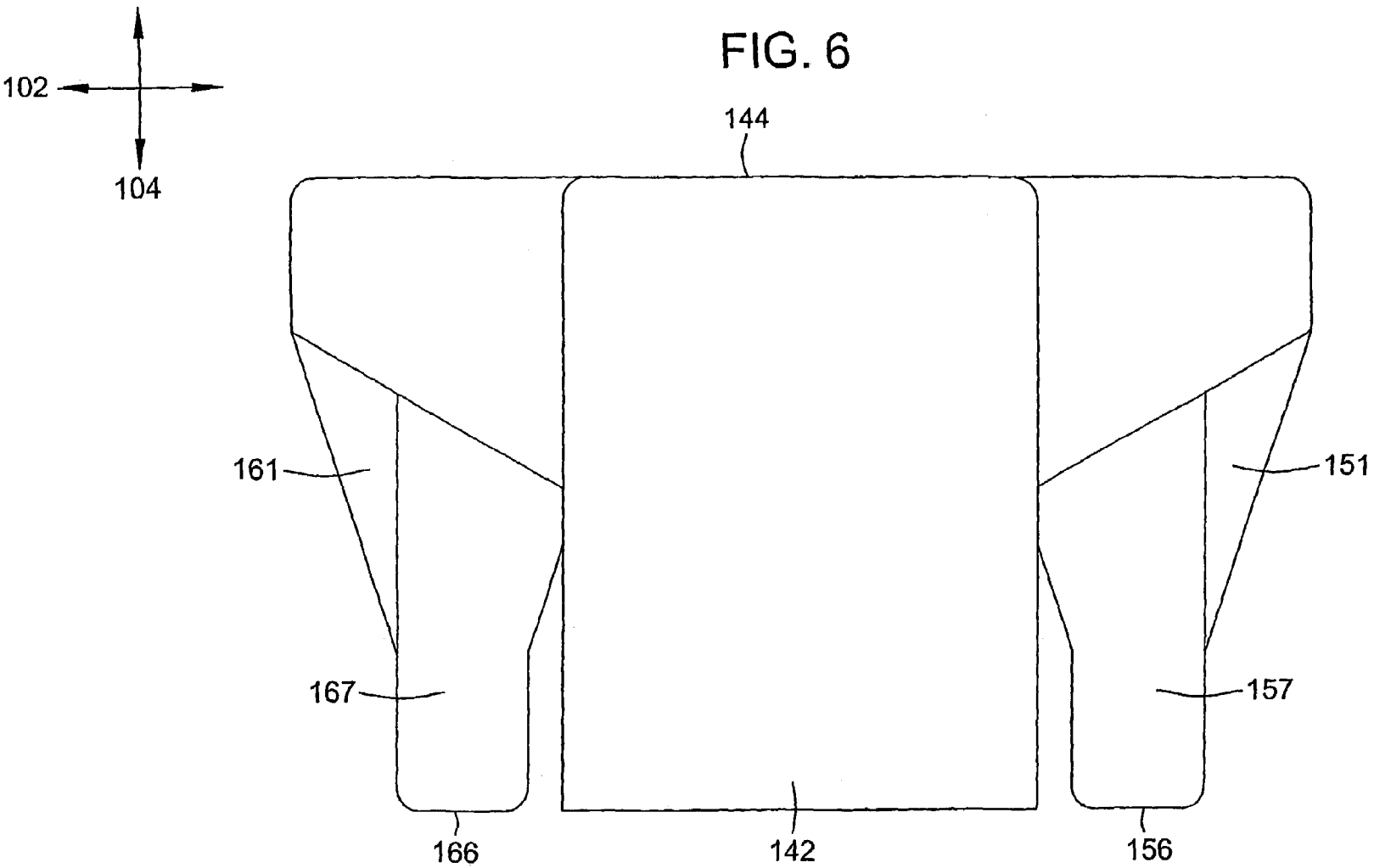
FIG. 6 is a left side view of the slider in FIG. 3.

The slider 132 includes front shoulders 150, 156 and rear shoulders 160, 166. Referring to FIGS. 3 and 4, the first front shoulder 150 merges into a first front arm 151 that extends vertically upward in the Z axis 106. The first front arm 151 merges into a first front pivot arm 152 that extends laterally along the Y axis 104 and merges into the second side portion 142. Similarly, referring to FIGS. 3 and 7, the first rear shoulder 160 merges into a first rear arm 161 that extends vertically upward in the Z axis 106. The first rear arm 161 merges into a first rear pivot arm 162 that extends laterally along the Y axis 104 and merges into the second side portion 142. This results in the first shoulders 150, 160 having a pivot point about the X axis 102 where the first pivot arms 152, 162 merge with the second side portion 142 respectively.

Referring to FIGS. 3 and 4, the second front shoulder 156 merges into a second front arm 157 that extends vertically upward in the Z axis 106. The second front arm 157 merges into a second front pivot arm 158 that extends laterally along the Y axis 104 and merges into the first side portion 140. Similarly, referring to FIGS. 3 and 7, the second rear shoulder 166 merges into a second rear arm 167 that extends vertically upward in the Z axis 106. The second rear arm 167 merges into a second rear pivot arm 168 that extends laterally along the Y axis 104 and merges into the first side portion 140. This results in the second shoulders 156, 166 having a pivot point about the X axis 102 where the second pivot arms 158, 168 merge with the first side portion 140 respectively.

Figures 7, 8, 9:
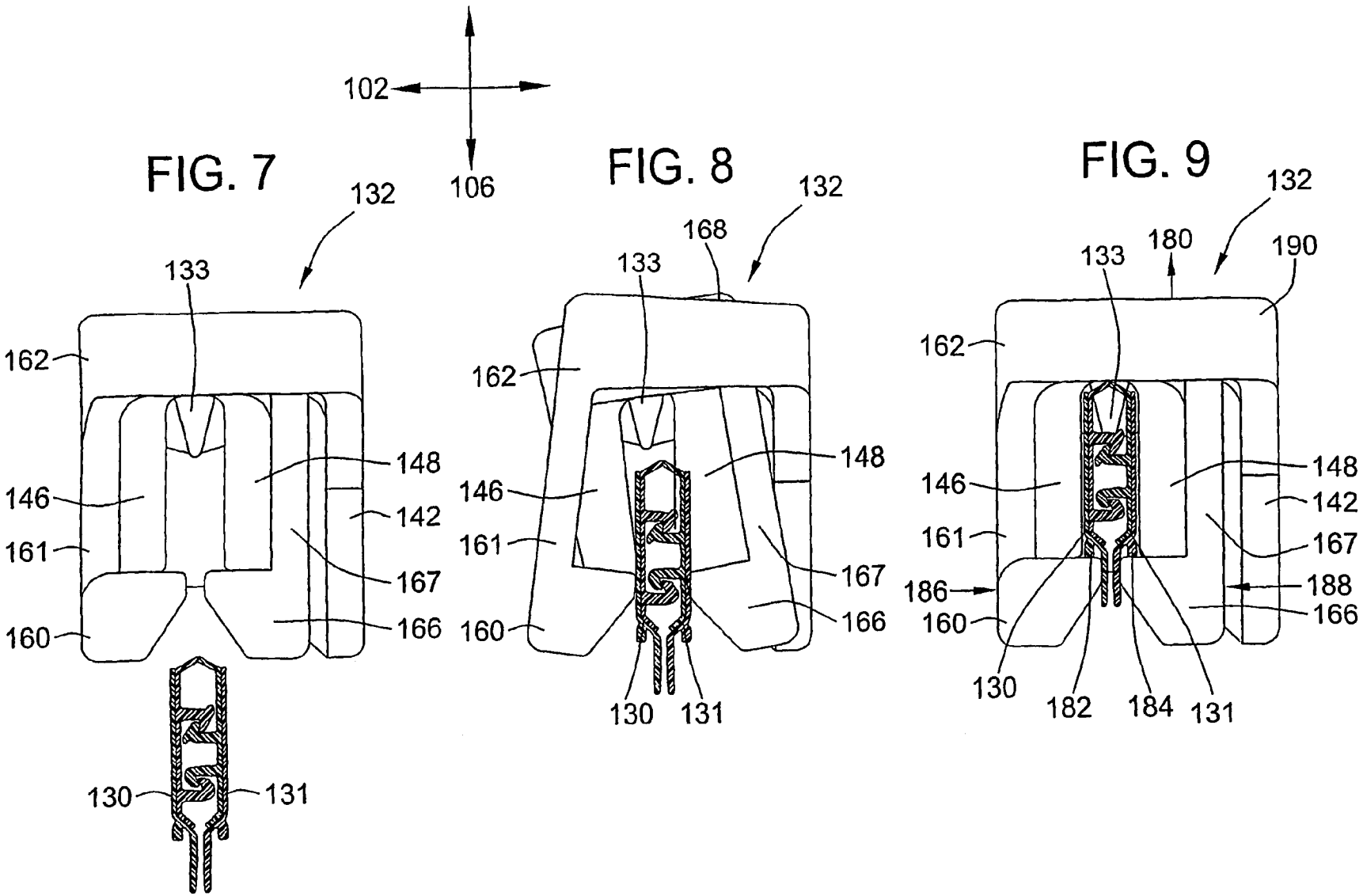
FIG. 7 is a rear view of the slider above the fastening strips.
FIG. 8 is a rear view of the slider partially on the fastening strips.
FIG. 9 is a rear view of the slider attached to the fastening strips.

FIGS. 7–9 sequentially illustrate the attachment of the slider 132 made in accordance with the present invention onto the fastening strips 130, 131 in the vertical Z axis 106. Although the following description will be limited to the slider components illustrated in the respective view described, it will be appreciated that the other slider components will function in a similar manner. For example, the first and second front shoulders 150, 156 of the slider 132 will operate in the same fashion as the first and second rear shoulders 160, 166 of the slider 132 during attachment of the slider 132 onto the fastening strips 130, 131.

FIG. 7 depicts occluded fastening strips 130, 131 and a slider 132 having first rear shoulder 160 and second rear shoulder 166 in a relaxed position. The occluded fastening strips 130, 131 are immediately below the slider 132. Referring to FIG. 8, the slider 132 is moved in the vertical Z axis 106 towards the fastening strips 130, 131. The fastening strips engage the rear shoulders 160, 166 and deflect the shoulders 160, 166 and their respective rear arms 161, 167 outwardly in the transverse Y axis 104. The rear pivot arms 162, 168 rotate about the X axis 102 at the point where the rear pivot arms 162, 168 merge with the side portions 142, 140 respectively. The rear pivot arms 162, 166 deflect upwardly in the vertical Z axis 106. The fastening strips 130, 131 are guided into the slider 132 by the occlusion members 146, 148.

As shown in FIG. 9, upon further movement of the fastening strips 130, 131 toward the slider 132 in the vertical Z axis 106, the first and second rear shoulders 160, 166 retract back to their relaxed position. In addition, the separator 133 is forced between the flanges of the occluded fastening strips 130, 131.

During use of the slider 132 on the fastening strips 130, 131, the user may exert an upward force 180 in the Z axis 106 on the slider 132 as shown in FIG. 9. The upward force 180 will cause the shoulders to engage the fastening strips. In this embodiment, the shoulders 150, 156, 160, 166 would engage the ribs 182, 184. If the user continues to apply the force 180, then the shoulders would move inward in directions 186, 188 to retain the fastening strips. In this embodiment, as the upward force 180 is applied, the force would be transmitted through the shoulder 160 to the rear arm 161 and the pivot arm 162. The pivot arm 162 would pivot at approximately point 190 and rotate in a counter clockwise direction. Thus, the shoulder 160 would move inward in direction 186 to retain the fastening strip. The other shoulders 150, 156, 166, arms and pivot arms would operate in a similar manner.

Figure 10:
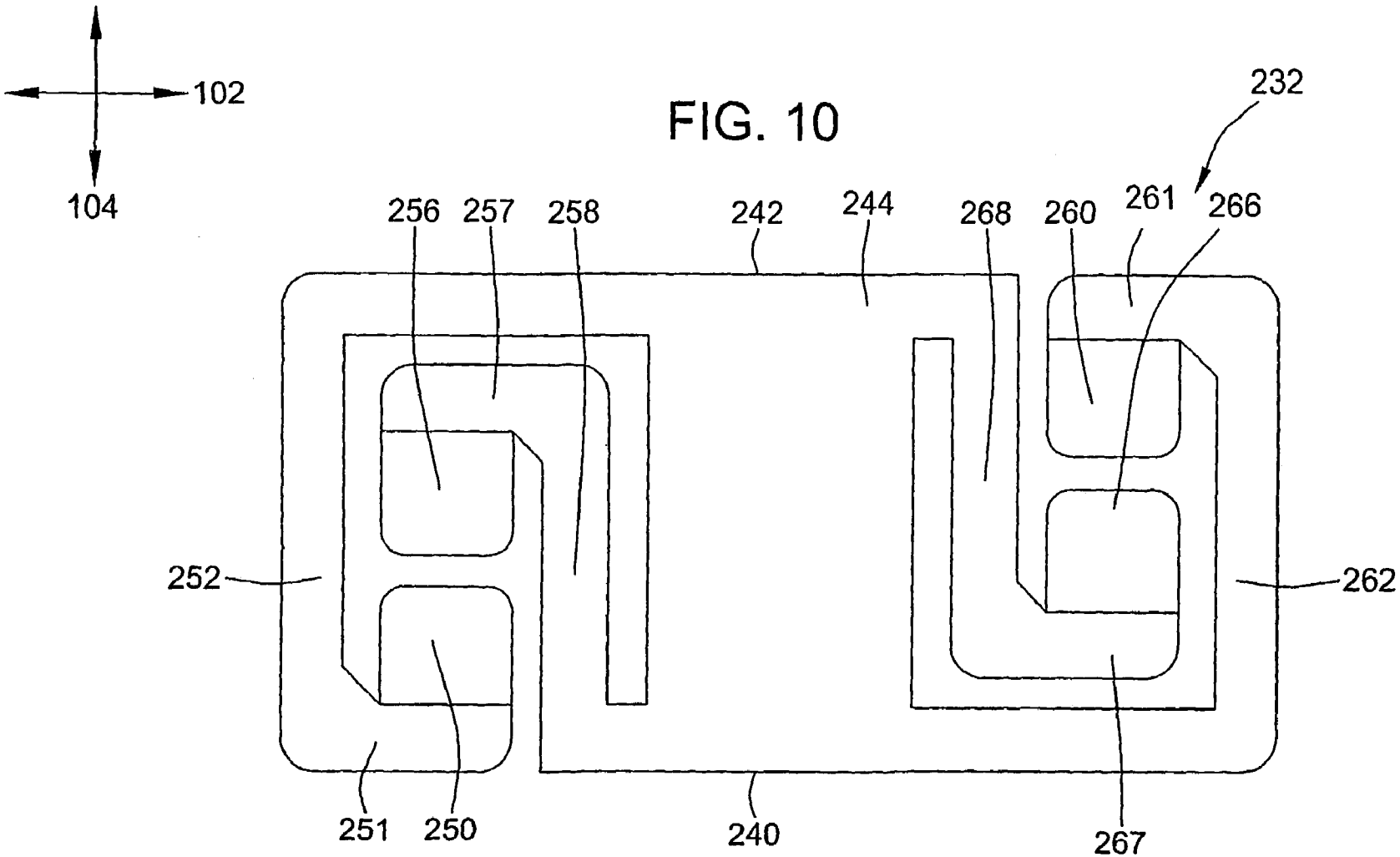
FIG. 10 is a top view of another embodiment of a slider.

FIG. 10 illustrates another embodiment of a slider 232. The slider 132 is generally designed such that the slider is symmetrical about the Y axis 104. In contrast to the slider 132, the slider 232 is generally designed such that the slider is rotationally symmetrical about the Z axis 106. The slider 232 includes first and second side portions 240, 242 and a top portion 244. The first end second front shoulders 250, 256 merge into the second and first side portions 242, 240 respectively through the front arms 251, 257 and the first and second pivot arms 252, 258. The first and second rear shoulders 260, 266 merge into the first and second side portion 240, 242 respectively through the rear arms 261, 267 and the first and second pivot arms 262, 268. The slider 232 would operate in a manner similar to slider 132.

In keeping with a general aspect of the present invention and as will be described in greater detail below, the interlocking fastening strips of the present invention may be of various types or forms.

Figure 11:
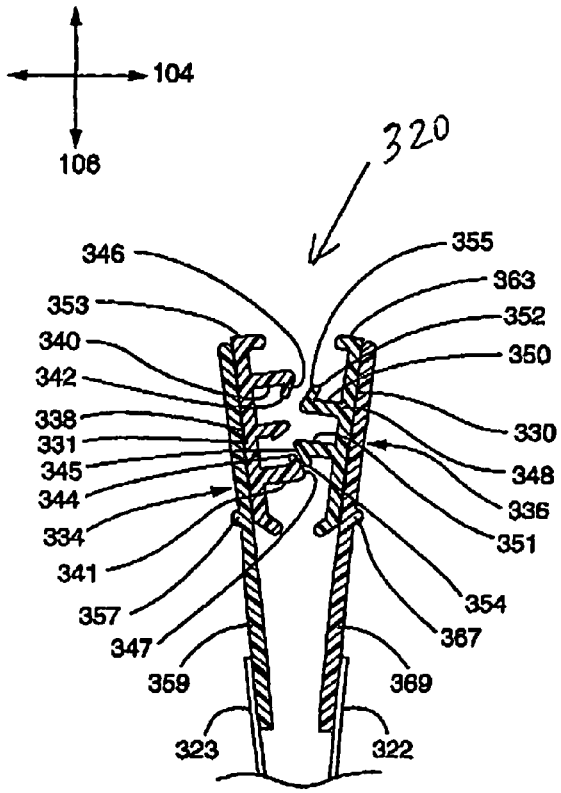
FIG. 11 is a rear view of the fastening strips.

As shown in FIG. 11, the fastening strips may be U-channel fastening strips as described in U.S. Pat. No. 4,829,641. U-channel fastening strips include a first fastening strip 330 with a first closure element 336 and a second fastening strip 331 with a second closure element 334. The first closure element 336 engages the second closure element 334. The first fastening strip 330 may include a flange 363 disposed at the upper end of the first fastening strip 330 and a rib 367 disposed at the lower end of the first fastening strip 330. The first fastening strip 330 may include a flange portion 369. Likewise, the second fastening strip 331 may include a flange 353 disposed at the upper end of the second fastening strip 331 and a rib 357 disposed at the lower end of the second fastening strip 331. The second fastening strip 331 may include a flange portion 359. The side walls 322, 323 of the plastic bag 320 may be attached to the fastening strips 330, 331 by conventional manufacturing techniques.

The second closure element 334 includes a base portion 338 having a pair of spaced-apart parallely disposed webs 340, 341, extending from the base portion 338. The base and the webs form a U-channel closure element. The webs 340, 341 include hook closure portions 342, 344 extending from the webs 340, 341 respectively, and facing towards each other. The hook closure portions 342, 344 include guide surfaces 346, 347 which serve to guide the hook closure portions 342, 344 for occluding with the book closure portions 352, 354 of the first closure element 336.

The first closure element 336 includes a base portion 348 including a pair of spaced-apart, parallely disposed webs 350, 351 extending from the base portion 348. The base and the webs form a U-channel closure element. The webs 350, 351 include hook closure portions 352, 354 extending from the webs 350, 351 respectively and facing away from each other. The hook closure portions 352, 354 include guide surfaces 345, 355, which generally serve to guide the hook closure portions 352, 354 for occlusion with the hook closure portions 342, 344 of the second closure element 334. The guide surfaces 345, 355 may also have a rounded crown surface.

When the slider is moved in the occlusion direction, the separator deoccludes the fastening strips 330, 331 as shown in FIG. 11. Referring to FIG. 11, the closure elements 334, 336 are deoccludes and specifically, the upper hook portions 342, 352 and the lower hook portions 344, 354 are deoccluded.

Figure 12:
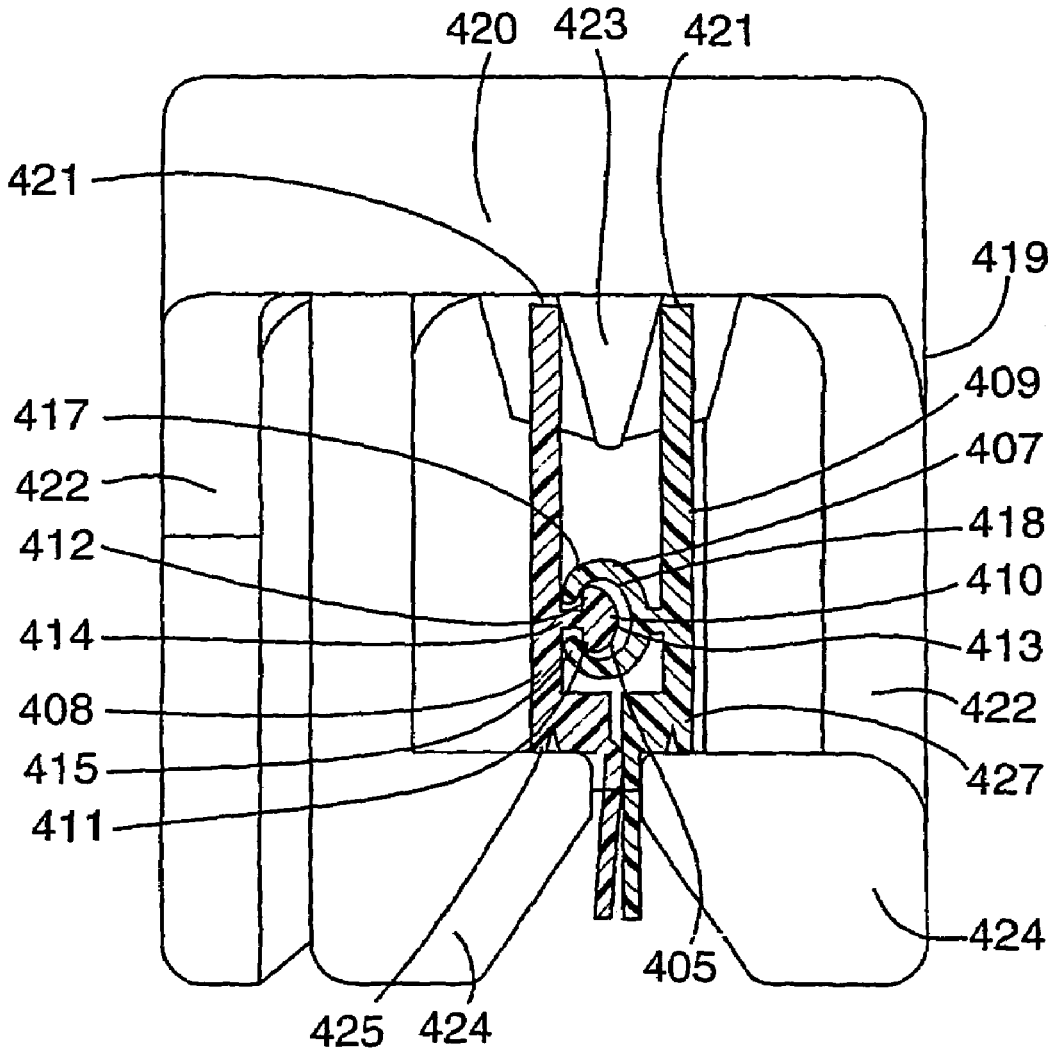
FIG. 12 is a rear view of another embodiment.

The interlocking fastening strips may comprise "arrowhead-type" or "rib and groove" fastening strips as shown in FIG. 12 and as described in U.S. Pat. No. 3,806,998. The rib element 405 interlocks with the groove element 407. The rib element 405 is of generally arrow-shape in transverse cross section including a head 410 comprising interlock shoulder hook portions 411 and 412 generally convergently related to provide a cam ridge 413 generally aligned with a stem flange 414 by which the head is connected in spaced relation with respect to the supporting flange portion 408. (U.S. Pat. No. 3,806,998, Col. 2, lines 16–23). At their surfaces nearest the connecting stem flange 414, the shoulder portions 411 and 412 define reentrant angles therewith providing interlock hooks engageable with interlock hook flanges 415 and 417 respectively of the groove element 407. (U.S. Pat. No. 3,806,998, Col. 2, lines 23–28). Said hook flanges generally converge toward one another and are spread open to receive the head 410 therebetween when said head is pressed into said groove element 407 until the head is fully received in a groove 418 of said groove element 407 generally complementary to the head and within which the head is interlocked by interengagement of the head shoulder hook portions 411 and 412 and the groove hook flanges 415 and 417. (U.S. Pat. No. 3,806,998, Col. 2, lines 28–36). Through this arrangement, as indicated, the head and groove elements 405 and 407 are adapted to be interlockingly engaged by being pressed together and to be separated when forcably pulled apart, as by means of a generally U-shaped slider 419. (U.S. Pat. No. 3,806,998, Col. 2, lines 36–41).

The slider 419 includes a flat back plate 420 adapted to run along free edges 421 on the upper ends of the sections of the flange portions 408 and 409 as shown in the drawing. (U.S. Pat. No. 3,806,998, Col. 2, lines 41–46). Integrally formed with the back plate 420 and extending in the same direction (downwardly as shown) therefrom are respective coextensive side walls 422 with an intermediate spreader finger 423 extending in the same direction as the side walls at one end of the slider. (U.S. Pat. No. 3,806,998, Col. 2, lines 46–51). The side walls 422 are in the form of panels which are laterally divergent from a narrower end of the slider. (U.S. Pat. No. 3,806,998, Col. 2, lines 51–55). The slider walls 422 are each provided with an inwardly projecting shoulder structure 424 flange adapted to engage respective shoulder ribs 425 and 427 on respectively outer sides of the lower section of the flange portions 408 and 409. (U.S. Pat. No. 3,806,998, Col. 2, line 66 to Co. 3, line 3).

Figure 13:
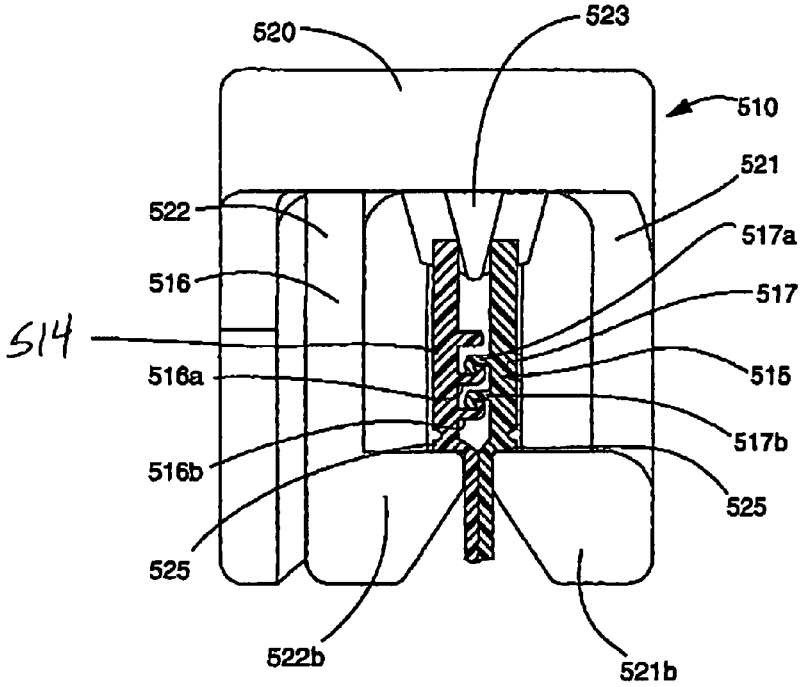
FIG. 13 is a rear view of another embodiment.

Additionally, the interlocking fastening strips may comprise "profile" fastening strips, as shown in FIG. 13 and described in U.S. Pat. No. 5,664,299. The first profile 516 has at least an uppermost closure element 516*a* and a bottommost closure element 516*b*. (U.S. Pat. No. 5,664,299, Col. 3, lines 25–27). The closure elements 516*a* and 516*b* project laterally from the inner surface of strip 514. (U.S. Pat. No. 5,664,299, Col. 3, lines 27–28). Likewise, the second profile 517 has at least an uppermost closure element 517*a* and a bottommost closure element 517*b*. (U.S. Pat. No. 5,664,299, Col. 3, lines 28–30). The closure elements 517*a* and 517*b* project laterally from the inner surface of strip 515. (U.S. Pat. No. 5,664,299, Col. 3, lines 30–32). When the bag is closed, the closure elements of profile 516 interlock with the corresponding closure elements of profile 517. (U.S. Pat. No. 5,664,299, Col. 3, lines 32–34). Closure elements 516*a*, 516*b*, 517*a* and 517*b* have hooks on the ends of the closure elements, so that the profiles remain interlocked when the bag is closed, thereby forming a seal. (U.S. Pat. No. 5,664,299, Col. 3, lines 34–37).

The straddling slider 510 comprises an inverted U-shaped member having a top 520 for moving along the top edges of the strips 514 and 515. (U.S. Pat. No. 5,664,299, Col. 4, lines 1–3). The slider 510 has side walls 521 and 522 depending from the top 520. (U.S. Pat. No. 5,664,299, Col. 4, lines 3–4). A separating leg 523 depends from the top 520 between the side walls 521 and 522 and is located between the uppermost closure elements 516*a* and 517*a* of profiles 516 and 517. (U.S. Pat. No. 5,664,299, Col. 4, lines 26–30). The fastening assembly includes ridges 525 on the outer surfaces of the fastening strips 514 and 515, and shoulders 521*b* and 522*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 525. (U.S. Pat. No. 5,664,299, Col. 5, lines 4–7).

Figure 14:
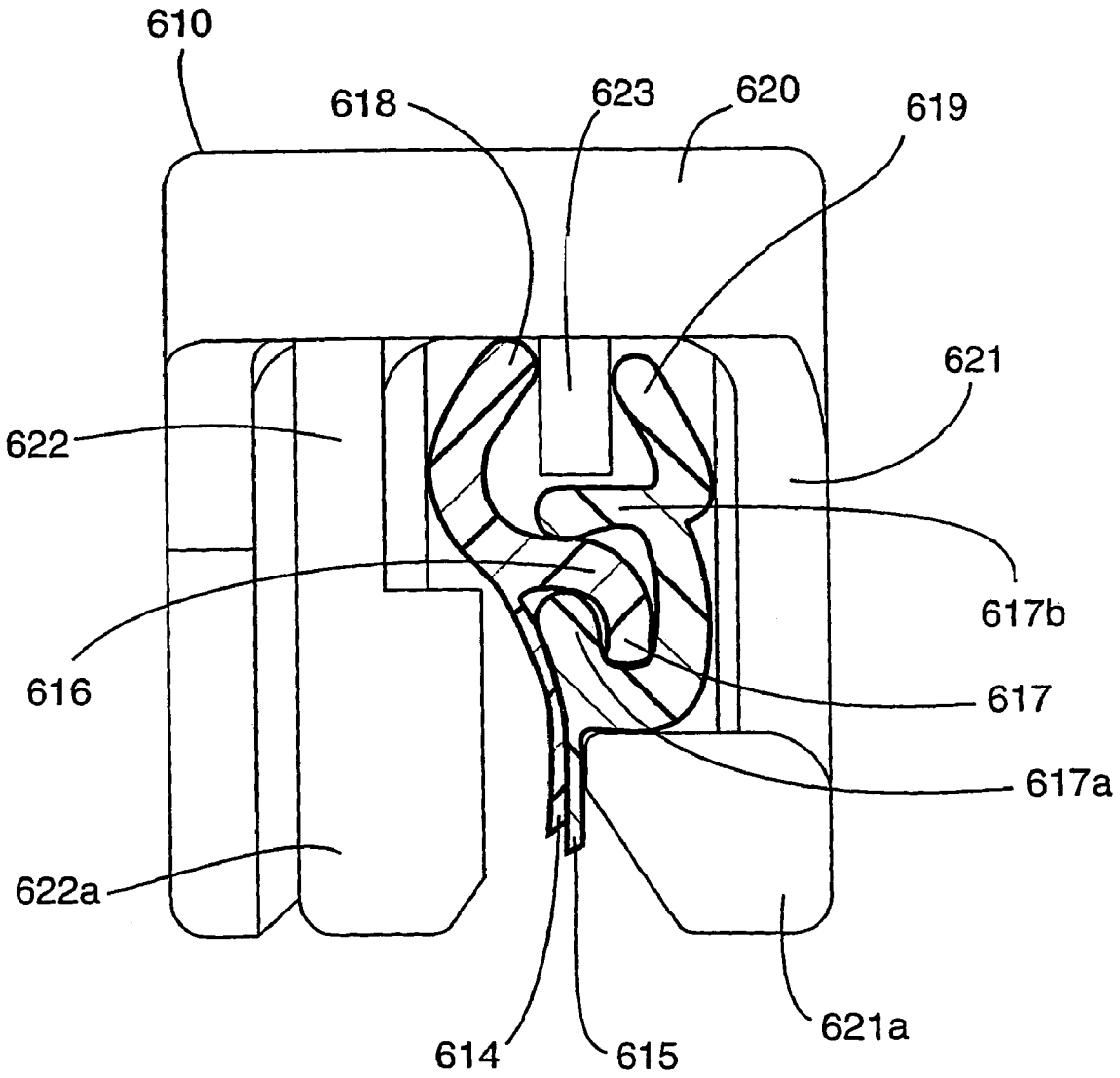
FIG. 14 is a rear view of another embodiment.

Also, the interlocking fastening strips may be "rolling action" fastening strips as shown in FIG. 14 and described in U.S. Pat. No. 5,007,143. The strips 614 and 615 include profiled tracks 618 and 619 extending along the length thereof parallel to the rib and groove elements 616 and 617 and the rib and groove elements 616, 617 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 616 is hook shaped and projects from the inner face of strip 614. (U.S. Pat. No. 5,007,143, Col. 5, lines 1–3). The groove element 617 includes a lower hook-shaped projection 617*a* and a relatively straight projection 617*b* which extend from the inner face of strip 615. (U.S. Pat. No. 5,007,143, Col. 5, lines 3–6). The profiled tracks 618 and 619 are inclined inwardly toward each other from their respective strips 614 and 615. (U.S. Pat. No. 5,007,143, Col. 5, lines 6–8).

The straddling slider 610 comprises an inverted U-shaped plastic member having a back 620 for moving along the top edges of the tracks 618 and 619 with side walls 621 and 622 depending therefrom for cooperating with the tracks and extending from an opening end of the slider to a closing end. (U.S. Pat. No. 5,007,143, Col. 5, lines 26–31). A separator finger 623 depends from the back 620 between the side walls 621 and 622 and is inserted between the inclined tracks 618 and 619. (U.S. Pat. No. 5,007,143, Col. 5, lines 34–36). The slider 610 has shoulders 621*a* and 622*a* projecting inwardly from the depending side walls 621 and 622 which are shaped throughout the length thereof for cooperation with the depending separator finger 623 in creating the rolling action in opening and closing the reclosable interlocking rib and groove profile elements 616 and 617. (U.S. Pat. No. 5,007, 143, Col. 5, lines 43–49).

Although several interlocking fastening strip embodiments have been specifically described and illustrated herein, it will be readily appreciated by those skilled in the art that other kinds, types, or forms of fastening strips may alternatively be used without departing from the scope or spirit of the present invention.

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. For example, the fastening strips may be made from low density polyethylene.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations.

The fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device, comprising:

first and second interlocking fastening strips arranged to be interlocked over a predetermined length;

a slider slidably disposed on the fastening strips, the slider facilitating occlusion of the fastening strips when moved in one direction, the slider facilitating deocclusion of the fastening strips when the slider is moved in an opposite direction, the slider includes a top portion, the slider includes a first side portion, the slider includes a second side portion, the first side portion includes a first pivot arm that extends outward from the first side portion and extends over the fastening strips, the first pivot arm includes a first shoulder; and the fastening strips and the slider having a longitudinal X axis and a transverse Y axis, the transverse Y axis being perpendicular to the longitudinal X axis, the fastening strips and the slider having a vertical Z axis, the vertical Z axis being perpendicular to the longitudinal X axis, the vertical Z axis being perpendicular to the transverse Y axis.

2. The invention as in claim 1 wherein the second side portion includes a second pivot arm that extends outward from the second side portion, the second pivot arm includes a second shoulder.

3. The invention as in claim 1 wherein the first side portion includes a second pivot arm that extends outward from the first side portion, the second pivot arm includes a second shoulder.

4. The invention as in claim 2 wherein the first side portion includes a third pivot arm that extends outward from the first side portion, the third pivot arm includes a third shoulder.

5. The invention as in claim 4 wherein the second side portion includes a fourth pivot arm that extends outward from the second side portion, the fourth pivot arm includes a fourth shoulder.

6. The invention as in claim 1 wherein the first pivot arm includes an arm portion which extends downward.

7. The invention as in claim 1 wherein the first shoulder moves inward towards the Y axis when the slider is moved upward along the Z axis.

8. The invention as in claim 1 wherein the first pivot arm pivots when the slider is moved upward in the Z axis.

9. The invention as in claim 1 wherein the fastening strips comprise U-channel type fastening strips.

10. The invention as in claim 1 wherein the fastening strips comprise arrowhead type fastening strips.

11. The invention as in claim 1 wherein the fastening snips comprise profile type fastening strips.

12. The invention as in claim 1 wherein the fastening strips comprise rolling action type fastening strips.

13. A container comprising:

first and second sidewalls joined to form a compartment with an opening;

first and second interlocking fastening strips respectively connected to the first and second sidewalls at the opening, the fastening strips being arranged to be interlocked over a predetermined length;

a slider slidably disposed on the fastening strips for movement between the fist and second ends, the slider facilitating occlusion of the fastening strips when moved in one direction, the slider facilitating deocclusion of the fastening strips when the slider is moved in an opposite direction, the slider includes atop portion, the slider includes a first side portion, the slider includes a second side portion;

the first side portion includes a first pivot arm that extends outward from first side portion and extends over the fastening strips, the first pivot arm includes a first shoulder; and the fastening strips and the slider having a longitudinal X axis and a transverse Y axis, the transverse Y axis being perpendicular to the longitudinal X axis, the fastening strips and the slider having a vertical Z axis, the vertical Z axis being perpendicular to the longitudinal X axis, the vertical Z axis being perpendicular to the transverse Y axis.

14. A method of manufacturing a closure device, comprising:

providing first and second interlocking fastening strips arranged to be interlocked over a predetermined length;

providing a slider slidably disposed on the fastening strips, the slider facilitating occlusion of the fastening strips when moved in one direction, the slider facilitating deocclusion of the fastening strips when the slider is moved in an opposite direction, the slider includes a top portion, the slider includes a first side portion, the slider includes a second side portion, the first side portion includes a first pivot arm that extends outward from the first side portion and extends over the fastening strips, the first pivot arm includes a first shoulder; and the fastening strips and the slider having a longitudinal X axis and a transverse Y axis, the transverse Y axis being perpendicular to the longitudinal X axis, the fastening strips and the slider having a vertical Z axis, the vertical Z axis being perpendicular to the longitudinal X axis, the vertical Z axis being perpendicular to the transverse Y axis.

* * * * *